US005906562A

United States Patent [19]

Lin

[11] Patent Number: 5,906,562

[45] Date of Patent: May 25, 1999

[54] STEPPING AND SWINGING EXERCISER

[76] Inventor: Ting Fung Lin, 12F-1, No. 83, Suei Yuan Road, Taipei, Taiwan

[21] Appl. No.: 09/152,642

[22] Filed: Sep. 14, 1998

Related U.S. Application Data

[63] Continuation-in-part of application No. 09/096,862, Jun. 12, 1998, and application No. 09/097,020, Jun. 12, 1998.

[51] Int. Cl.[6] ..... A63B 22/64

[52] U.S. Cl. ..... 482/53; 482/147

[58] Field of Search ..... 482/51, 52, 53, 482/57, 70, 71, 79, 80, 146–147

[56] References Cited

U.S. PATENT DOCUMENTS

| | | | |
|---|---|---|---|
| 4,563,001 | 1/1986 | Terauds | 272/72 |
| 4,838,543 | 6/1989 | Armstrong et al. | 482/53 |
| 4,940,233 | 7/1990 | Bull et al. | 272/130 |
| 5,039,088 | 8/1991 | Shifferaw | 272/73 |
| 5,453,065 | 9/1995 | Lien et al. | 482/53 |
| 5,545,111 | 8/1996 | Wang et al. | 482/53 |
| 5,595,555 | 1/1997 | Chen | 482/51 |
| 5,628,709 | 5/1997 | Chen | 482/53 |
| 5,645,512 | 7/1997 | Yu | 482/53 |
| 5,749,809 | 5/1998 | Lin | 482/52 |

*Primary Examiner*—Stephen R. Crow

[57] ABSTRACT

An exerciser includes a post having a lower portion rotatably secured to a base. Two pulleys are rotatably supported on the base. Two foot supports are pivotally supported on the base and are coupled to the post by one or two cables which are engaged over the pulleys and the post, such that the foot supports may rotate the post via the pulleys and the cables and such that the user may twist his body while stepping with the foot supports. Two actuators are coupled to the foot supports for applying the resistive force against the foot supports.

8 Claims, 2 Drawing Sheets

STEPPING AND SWINGING EXERCISER

The present invention is a continuation-in-part-of U.S. patent application Ser. No. 09/096,862, filed Jun. 12, 1998, entitled "SWINGING AND STEPPING EXERCISER"; and Ser. No. 09/097,020, filed on Jun. 12, 1998, entitled "STEPPING AND SWINGING EXERCISER".

BACKGROUND OF THE INVENTION

1. Field of the Invention

The present invention relates to an exerciser, and more particularly to a stepping and swinging exerciser.

2. Description of the Prior Art

Two typical stepping exercisers are disclosed in U.S. Pat. No. 5,545,111 to Wang et al. and U.S. Pat. No. 5,645,512 to Yu and comprise a complicated structure for coupling the handle to the foot supports and for allowing the handle to be rotated by the foot supports. However, the structures are complicated such that the manufacturing costs are greatly increased.

The applicant had developed a swinging and stepping exerciser and issued as U.S. Pat. No. 5,749,809 to Lin, which includes a pair of foot supports coupled to a handle by a gear engagement.

The present invention has arisen to provide a novel stepping exerciser.

SUMMARY OF THE INVENTION

The primary objective of the present invention is to provide a stepping and swinging exerciser which includes a greatly simplified structure for allowing the user to conduct both stepping and swinging exercises and for decreasing the manufacturing cost of the exerciser.

In accordance with one aspect of the invention, there is provided an exerciser comprising a base including a pivot shaft provided thereon, a post including a lower portion rotatably secured to the base, a pair of pulleys rotatably supported on the pivot shaft, a pair of foot supports pivotally supported on the base at a pivot axle, and at least one link engaged over the pulleys and the post and including two ends secured to the foot supports respectively for coupling the foot supports to the post and for rotating the post via the pulleys and the link.

A barrel is further rotatably engaged on the post, and means for securing the barrel to the post. The barrel includes a follower secured thereon, the link includes a middle portion engaged over the follower for rotating the post via the follower and the barrel. A securing means is further provided for securing the middle portion of the link to the follower.

A stop means is further provided for preventing the link from being disengaged from the pulleys.

A resistive means is further provided for applying a resistive force against the foot supports and includes two actuators secured between the pivot shaft and the foot supports for applying the resistive force against the foot supports. The foot supports each includes a slot formed therein, the actuators each includes a lower bracket slidably engaged in the slot of the respective foot supports for allowing the lower brackets to be adjusted along the slots respectively, and means for securing the lower brackets to the foot supports respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 2:
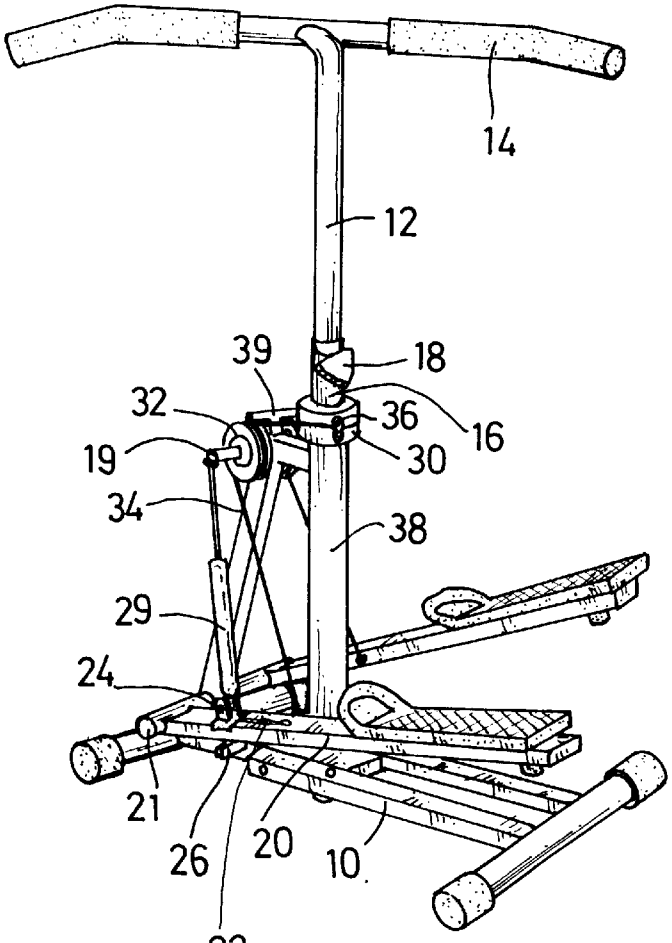
FIGS. 1 and 2 are perspective views illustrating the operation of an exerciser in accordance with the present invention.
Figure 1:
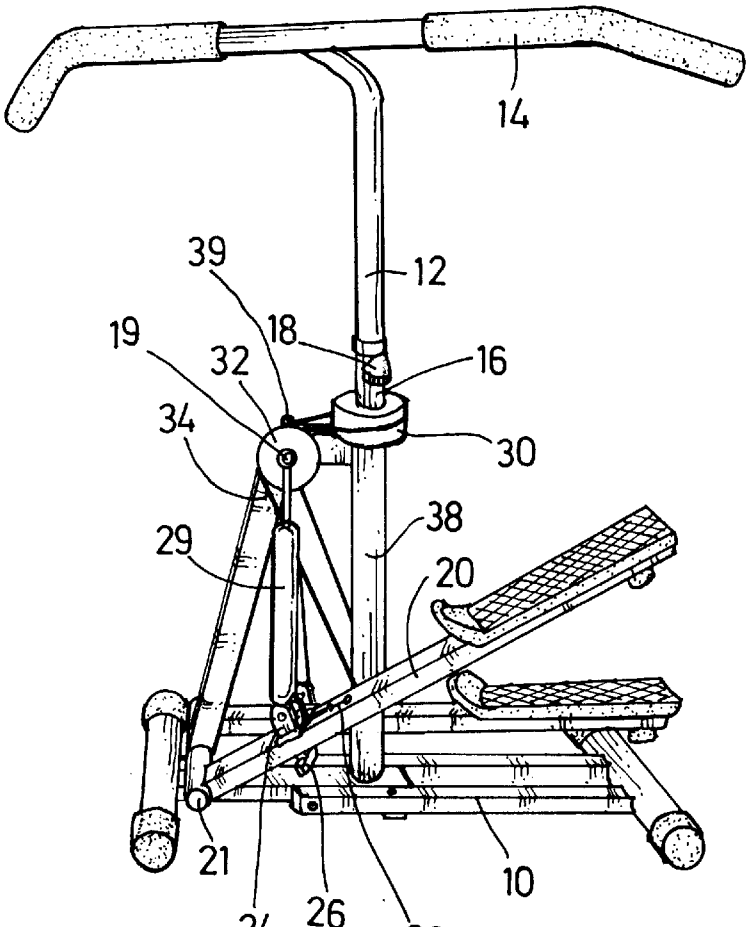
Figure 4:
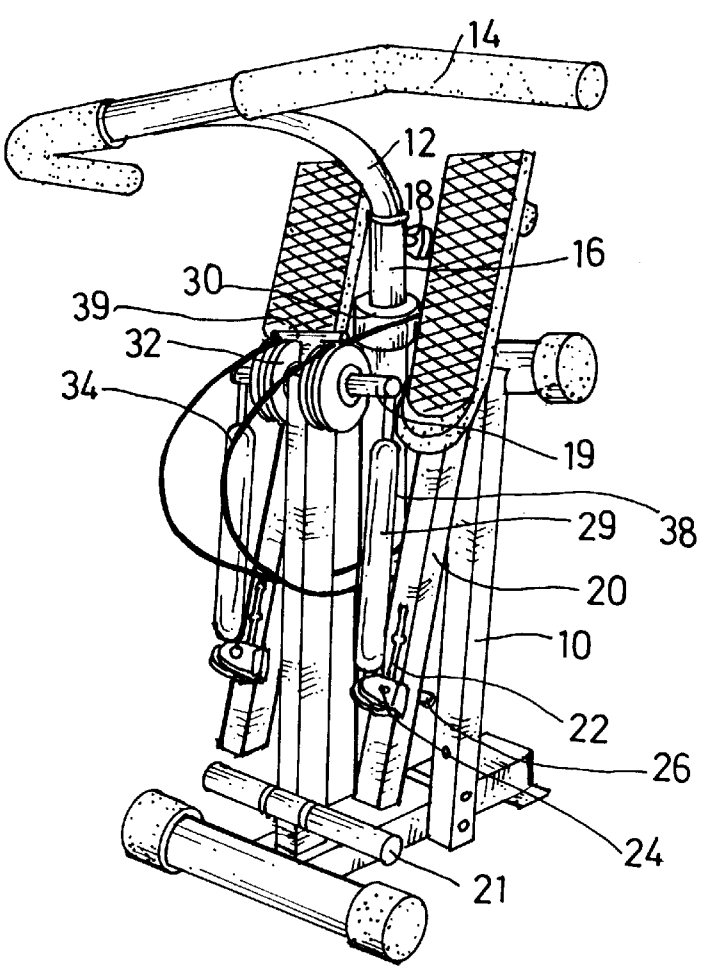
FIG. 4 is a perspective view illustrating the folding structure of the exerciser.
Figure 3:
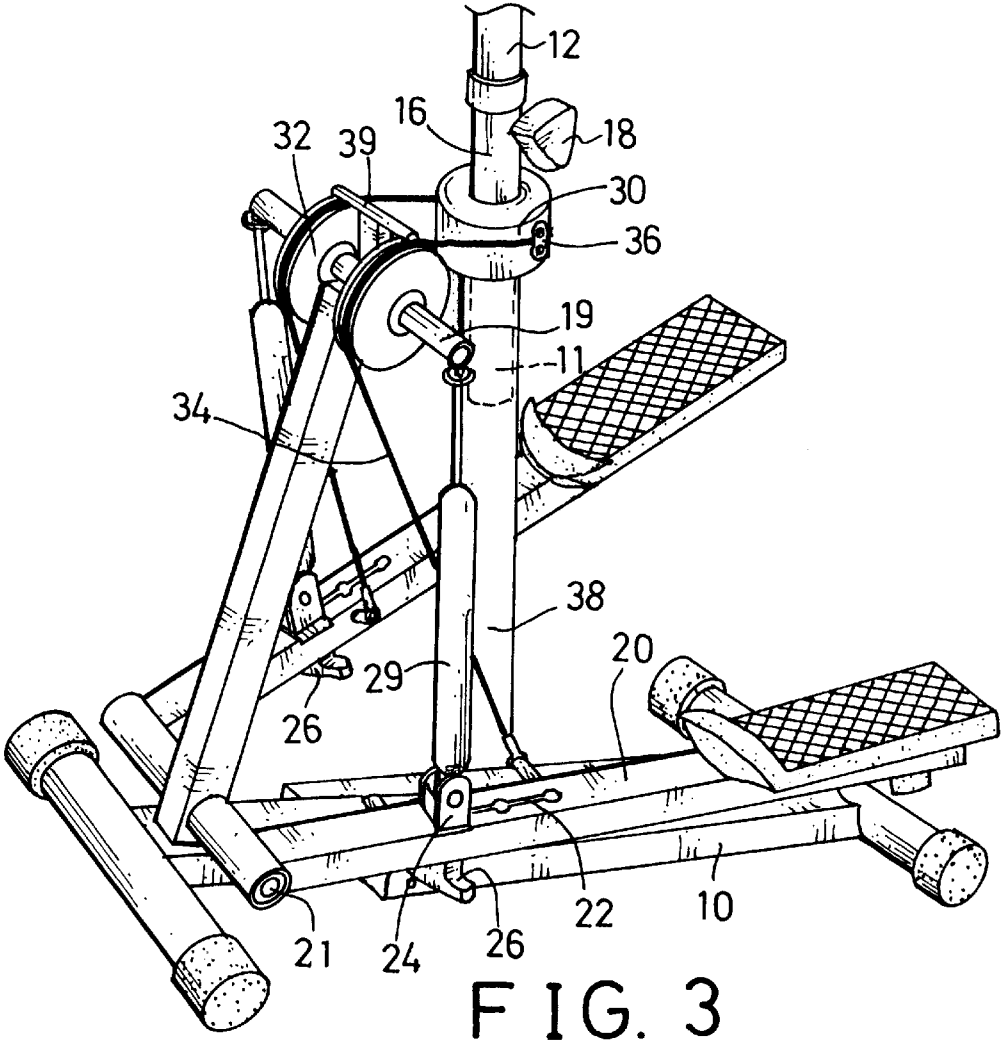
FIG. 3 is an enlarged partial perspective view of the exerciser.

Referring to the drawings, and initially to FIGS. 1–3, a stepping and swinging exerciser in accordance with the present invention comprises a base 10 including a tube 11 extended upward from the middle portion of the base 10 and a post 12 having a lower portion rotatably secured in the tube 11 by bearings and having a handle 14 provided on top thereof. A clamping ring or the like may be used for rotatably coupling the lower portion of the post 12 to the tube 11 and for preventing the post 12 from being disengaged from the tube 11. The post 12 may also be rotatably secured to the base 10 directly without the tube 11. As shown in the drawings, a barrel 16 is engaged on the post 12 and secured to the post 12 by a fastener 18 such that the post 12 and the barrel 16 rotate in concert with each other. The post 12 may be received in the tube 11 when the fastener 18 is released (FIG. 4).

A pair of foot supports 20 each includes a front portion pivotally secured to the base 10 at a pivot axle 21 for allowing the foot supports 20 to be rotated about the pivot axle 21. A follower 30 is secured to the barrel 16, or may be directly secured to the post 12 and rotated in concert with the post 12. The base 10 includes a pivot shaft 19 secured to the upper and front portion of the tube 11 and preferably parallel to the pivot axle 21. Two pulleys 32 are rotatably supported on the pivot shaft 19 and preferably perpendicular to the pivot shaft 19. A link, such as a cable 34, has a middle portion engaged over the follower 30 and then engaged over the pulleys 32 and has two ends secured to the foot supports 20 respectively, such that the foot supports 20 are coupled together via the link 34, and such that the post 12 and the handle 14 may be rotated by the foot supports 20 via the pulleys 32 and the follower 30 and the link 34. A fastener 36 may secure the link 34 to the follower 30 for allowing the follower 30 to be solidly or tightly rotated by the link 34.

Alternatively, the link 34 may also be engaged with the follower 30 with a frictional engagement for allowing the follower 30 to be rotated by the link 34 without the fastener 36. Instead of a single link 34, two cables 34 may be provided and each includes a lower end secured to the respective foot support 20 and each includes a middle portion engaged over the respective pulley 32 and each includes an upper end secured to the follower 30, such that the follower 30 may also be rotated in a reciprocating action by the foot supports 20. Without the follower 30, the link 34 may also be directly secured to the post 12 such that the post 12 may also be rotated by the foot supports 20 via the pulleys 32 and the link 34. A bar 39 is secured on the pivot shaft 19 and includes two ends disposed right above the pulleys 32 for preventing the link 34 from being disengaged from the pulleys 32. The bar 39 does not contact with the pulleys 32 and will not interfere with the rotational movement of the pulleys 32.

Two actuators 38 may be secured between the foot supports 20 and the pivot shaft 11 of the base 10 for applying a resistive force against the foot supports 20. As best shown in FIG. 3, the foot supports 20 each preferably includes a slot 22 formed in the middle portion along a longitudinal direction of the foot support 20. The actuators 38 each includes a lower bracket 24 slidably engaged in the slot 22 and secured to the foot support 20 by a fastener 26 for allowing the lower bracket 24 of the actuators 38 to be adjusted forward and rearward about the foot supports 20. The actuators 38 may apply a greater force against the foot supports 20 when the lower brackets 24 are adjusted rearward along the slots 22 respectively.

In operation, the follower 30 and thus the barrel 16 and the post 12 may be rotated by the foot supports 20 via the pulleys 32 and the link 34, such that the user may conduct swinging exercise in addition to the stepping exercise.

As shown in FIG. 4, the post 12 may be received in the tube 11, and the foot supports 20 may be rotated upward about the pivot axle 21, and the base 10 may include a rear portion that may be rotated about the front portion of the base 10 to a perpendicular position relative to the front portion of the base 10 or parallel to the tube 11, such that the exerciser may be folded to a compact configuration for facilitating the storing and transportation purposes of the exerciser.

Accordingly, the exerciser in accordance with the present invention includes a greatly simplified structure for allowing the user to conduct both stepping and swinging exercises and for decreasing the manufacturing cost of the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base including a pivot shaft provided thereon, a post including a lower portion rotatably secured to said base, a pair of pulleys rotatably supported on said pivot shaft, a pair of foot supports pivotally supported on said base at a pivot axle, and at least one link engaged over said pulleys and said post and including two ends secured to said foot supports respectively for coupling said foot supports to said post and for rotating said post via said pulleys and said at least one link.

2. The exerciser according to claim 1 further comprising a barrel rotatably engaged on said post, and means for securing said barrel to said post.

3. The exerciser according to claim 2, wherein said barrel includes a follower secured thereon, said at least one link includes a middle portion engaged over said follower for rotating said post via said follower and said barrel.

4. The exerciser according to claim 3 further comprising means for securing said middle portion of said at least one link to said follower.

5. The exerciser according to claim 1 further comprising means for preventing said at least one link from being disengaged from said pulleys.

6. The exerciser according to claim 1 further comprising means for applying a resistive force against said foot supports.

7. The exerciser according to claim 6, wherein said resistive force applying means includes two actuators secured between said pivot shaft and said foot supports for applying the resistive force against said foot supports.

8. The exerciser according to claim 7, wherein said foot supports each includes a slot formed therein, said actuators each includes a lower bracket slidably engaged in said slot of said respective foot supports for allowing said lower brackets to be adjusted along said slots respectively, and means for securing said lower brackets to said foot supports respectively.

* * * * *